US010030867B2

(12) United States Patent
Nicolia et al.

(10) Patent No.: US 10,030,867 B2
(45) Date of Patent: Jul. 24, 2018

(54) RADIANT HEAT INSERT

(71) Applicant: PSNergy, LLC, Erie, PA (US)

(72) Inventors: Carl R. Nicolia, Erie, PA (US); Paul Koch, Chagrin Falls, OH (US); Michael W. Alabran, Waterford, PA (US); Christopher M. Wyant, Townville, PA (US); John Williams, Stevens, PA (US); Ryan Purtel, Bethel Park, PA (US); Benjamin Johnston, Erie, PA (US); Tyler Schnieder, Johnsonburg, PA (US); Carey Rozanski, Erie, PA (US)

(73) Assignee: PSNergy, LLC, Erie, PA (US)

( * ) Notice: Subject to any disclaimer, the term of this patent is extended or adjusted under 35 U.S.C. 154(b) by 373 days.

(21) Appl. No.: 14/489,013

(22) Filed: Sep. 17, 2014

(65) Prior Publication Data

US 2015/0079529 A1 Mar. 19, 2015

Related U.S. Application Data

(60) Provisional application No. 61/879,902, filed on Sep. 19, 2013, provisional application No. 61/879,912, filed on Sep. 19, 2013.

(51) Int. Cl.

| | |
|---|---|
| ***F23C 3/00*** | (2006.01) |
| ***F23D 14/12*** | (2006.01) |
| ***F23M 9/08*** | (2006.01) |

(52) U.S. Cl.

CPC ..... *F23C 3/002* (2013.01); *F23M 9/08* (2013.01)

(58) Field of Classification Search

CPC ..... F16L 9/18; F16L 9/19; F16L 9/20; F28F 13/06; F28F 13/08; F28F 13/12; F28F 13/14

See application file for complete search history.

(56) References Cited

U.S. PATENT DOCUMENTS 1,242,473 A * 10/1917 Prentice ..... F28F 13/12 122/462
2,387,883 A 10/1945 Dake
(Continued)

FOREIGN PATENT DOCUMENTS

FR 773584 A * 11/1934 ..... F16L 9/18
JP 200248334 A 2/2002
(Continued)

OTHER PUBLICATIONS

"International Preliminary Report on Patentability for International Application No. PCT/US2014/056286", dated Mar. 22, 2016.

*Primary Examiner* — Steven B McAllister
*Assistant Examiner* — Steven Anderson, II
(74) *Attorney, Agent, or Firm* — The Webb Law Firm

(57) ABSTRACT

An insert for a radiant tube of a furnace including a first section adapted to absorb heat from combustion gases passing through the radiant tube and radiantly transfer the heat to a wall of the radiant tube and a second section for directing heat and gases in the radiant tube toward the first section of the insert and a system including a radiant tube and one or more such inserts. Also, a method of improving heat transfer from a radiant tube of a furnace to the material being heated including supplying an insert as described above and placing the insert into the radiant tube such that the first section corresponds to a portion of the radiant tube that is closest to the material being heated. Also, an insert for a radiant tube of a furnace including a ceramic body and a metal deposited on the surface of the ceramic body.

14 Claims, 5 Drawing Sheets

(56) References Cited

U.S. PATENT DOCUMENTS

| | | | | | |
|---|---|---|---|---|---|
| 2,670,722 | A | | 3/1954 | Huet | |
| 3,071,159 | A | | 1/1963 | Coraggioso | |
| 3,476,180 | A | | 11/1969 | Straight, Jr. et al. | |
| 3,731,738 | A | | 5/1973 | Cooper | |
| 3,920,383 | A | | 11/1975 | Kerr | |
| 4,113,009 | A | | 9/1978 | Meyer et al. | |
| 4,206,875 | A | | 6/1980 | Grasso | |
| 4,559,998 | A | | 12/1985 | Counterman | |
| 4,685,514 | A | | 8/1987 | Brown | |
| 4,705,106 | A | | 11/1987 | Hornack et al. | |
| 5,650,127 | A | * | 7/1997 | Campbell | B01D 53/75 423/239.1 |
| 5,655,599 | A | | 8/1997 | Kasprzyk | |
| 6,286,465 | B1 | * | 9/2001 | Hughes | F23M 9/003 122/155.2 |
| 6,364,658 | B1 | | 4/2002 | Ganeshan | |
| 6,526,898 | B1 | | 3/2003 | Ganeshan | |
| 2001/0035135 | A1 | * | 11/2001 | Hughes | F23M 9/003 122/155.2 |
| 2007/0224565 | A1 | * | 9/2007 | Briselden | F23C 3/002 431/207 |
| 2008/0283047 | A1 | | 11/2008 | Vancak | |
| 2009/0277969 | A1 | | 11/2009 | Briselden | |

FOREIGN PATENT DOCUMENTS

| | | | | | |
|---|---|---|---|---|---|
| JP | 2004309075 | A | * | 11/2004 | F28F 1/40 |
| WO | WO2012059250 | | * | 5/2012 | |

* cited by examiner

RADIANT HEAT INSERT

CROSS REFERENCE TO RELATED APPLICATIONS

The present application claims priority to U.S. Provisional Patent Application No. 61/879,902 filed Sep. 19, 2013 entitled "Radiant Heat Insert" and U.S. Provisional Patent Application No. 61/879,912 filed Sep. 19, 2013 entitled "Radiant Heat Insert", the entire disclosures of which are herein incorporated by reference.

BACKGROUND OF THE INVENTION

Field of the Invention

The present invention relates to an insert for placement in the tubes of a radiant tube furnace to increase heat transfer to the material being heated and to improve the fuel efficiency of the furnace. More particularly, it relates to a radiant tube insert that transfers more heat to the portion of the radiant tube that is closest to the material being heated.

Description of the Related Art

Radiant tube combustion furnaces are commonly used to heat materials such as ferrous and non-ferrous metals including steel and aluminum. Such radiant tube furnaces may be continuous furnaces where the material being heated is continuously passed through the furnace or may be batch furnaces where a large load of material is placed in the furnace. As an example a radiant tube continuous combustion furnace 10, as illustrated in FIGS. 1 and 2, is a generally rectangular box-shaped structure having a roof 11, a floor 13, and two side walls 15. Two sets of radiant tubes 12 are located in the furnace, an upper set that is closer to the roof and a lower set that is closer to the floor. The material 14 being heated is passed between the upper set of radiant tubes 12 and the lower set of radiant tubes 12. Each radiant tube 12 has a burner section 16 attached to a combustion burner 17 and an exhaust section 18 through which the combustion gases, commonly referred to as flue gas, exit the radiant tube 12. While FIGS. 1 and 2 show a U-shaped radiant tube, the radiant tube may take other suitable shapes including straight and W-shaped. Heat generated by the combustion burner 17 is transferred through the walls of the radiant tube 12 to the material 14 being heated. In the burner section 16, thermal energy from the inside of the radiant tube 12 can be transmitted from the radiant tube 12 through convection from the high temperature combusted gas passing through the tube 12 and, near the burner end, by radiation from the bright combustion flame. In the exhaust section 18, thermal energy can only be transmitted through convection from the remaining combustion gas passing through the tube 12. Further, the available heat in the exhaust section 18 is lower because the combustion gas loses energy while traveling down the radiant tube 12, as indicated by directional arrows 20, causing the combustion gas at the exhaust end of the tube 12 to be at a significantly lower temperature than at the burner end.

Because of this configuration, more thermal energy is transmitted from the burner section 16 relative to the exhaust section 18. This creates uneven heat transfer to the material 14 that is being heated, which, in this case, is travelling in a direction perpendicular to the radiant tubes 12 as indicated by arrows 22 and, in the case of a batch furnace, is stationary. A large amount of thermal energy is also wasted in the exhaust section 18, as most of the thermal energy exits the furnace 10 without any means to direct it to the material 14 being heated.

Inserts that can be arranged inside of the exhaust section 18 have been previously created in order to increase the overall heat transfer to the material 14 being heated, as well as, to more evenly distribute the amount of energy given off by the burner section 16 and the exhaust section 18. This is accomplished by mixing and forcing more exhaust gas to the interior surface 24 of the radiant tube 12, as well as by transmitting radiant energy that the insert collects. These designs have been proven to increase furnace efficiency by 5-20%, which reduces costs of continuous furnace operation.

SUMMARY OF THE INVENTION

The present invention is directed to an insert for a radiant tube of a furnace including a first section adapted to absorb heat from the combustion gases passing through the radiant tube and radiantly transfer the heat to a wall of the radiant tube and a second section for directing heat and gases in the radiant tube toward the first section of the insert. The shape of at least a portion of the first section may approximate the shape of the radiant tube and may include a tubular member having a first end, a second end, and a sidewall extending between the first end and the second end and defining at least one central passageway. The second section may include at least one wing extending from an exterior surface of the tubular member. At least a portion of the sidewall of the tubular member may be flat and at least a portion of the tubular member may be curved. The cross-section of the sidewall of the tubular member may be a semi-circle or a sector of a circle. The insert may further include at least one projection extending from an exterior surface of the curved portion of the sidewall of the tubular member.

The at least one wing may have a first end corresponding to the first end of the tubular member and a second end corresponding to the second end of the tubular member, and an exterior surface of the wing may slope in a downward direction from the first end of the wing to the second end of the wing. Further, a laterally outer edge of the second end of the wing may be closer to the tubular member than a laterally outer edge of the first end of the wing. The shape of the at least one wing may be adapted to direct heat and gases in an outward and downward direction toward an external surface of the tubular member.

The maximum width of the second section of the insert may be equal to or smaller than the maximum width of the first section, and the maximum length of the second section may be equal to or shorter than the maximum length of the first section.

The insert may further include a connection channel.

The insert may be constructed from a ceramic. The ceramic may be silicon carbide and may also include a metal deposited on its surface.

The invention is also directed to a method of improving heat transfer from a radiant tube of a furnace to the material being heated in the furnace including supplying an insert having a first section for radiantly transferring heat to a wall of the radiant tube and a second section for directing heat and gases in the radiant tube toward the first section of the insert and placing the insert into the radiant tube such that the first section corresponds to a portion of the radiant tube that is closest to the material being heated. A gap may be provided between an outer surface of the first section of the insert and an inner surface of the radiant tube and the second section of the insert may direct heat and gases into the gap. The first section of the insert and the second section of the insert may have the features described above.

The invention is also directed to an insert for a radiant tube of a furnace including a ceramic body and a metal deposited on the surface of the ceramic body. The metal may be at least one of palladium and platinum.

The invention is also directed to a system for radiantly conducting heat to a material, the system including a radiant tube having a fluid passageway and one or more inserts provided in the fluid passageway, wherein the inserts comprise a first section adapted to absorb heat from the combustion gases passing through the radiant tube and radiantly transfer the heat to a wall of the radiant tube and a second section for directing heat and gases in the radiant tube toward the first section of the insert. The first section of the insert and the second section of the insert may have the features described above. The system may include a plurality of inserts that are connected to one another within the fluid passageway.

DESCRIPTION OF THE INVENTION

Figure 1:
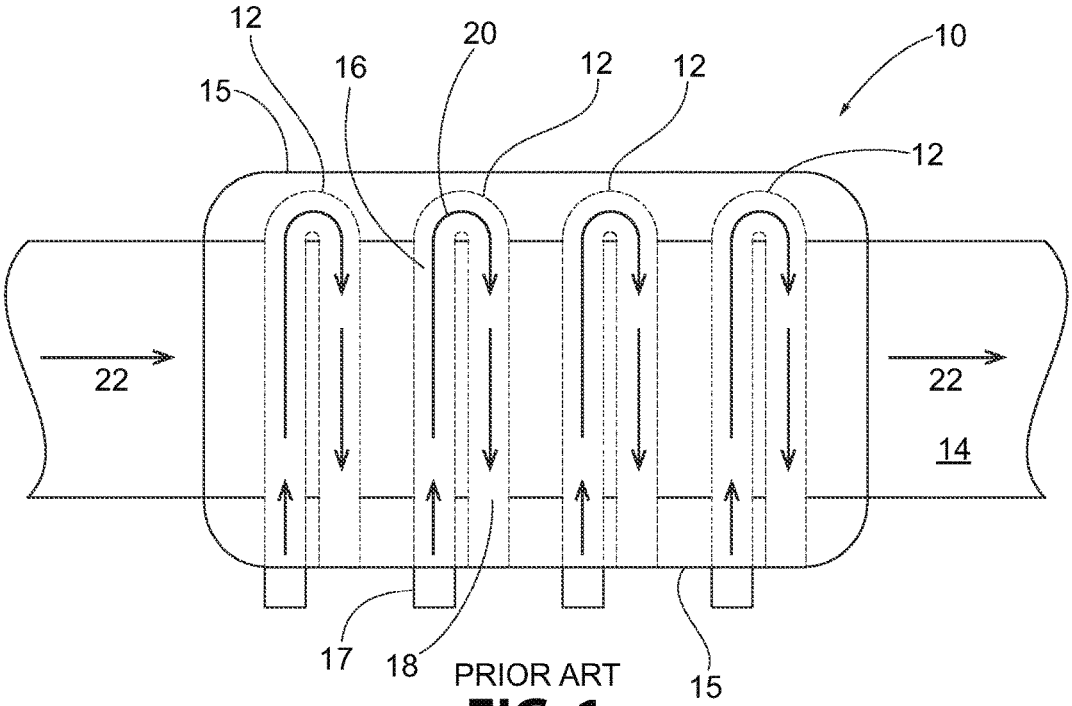
PRIOR ART FIG. 1
FIG. 1 is a top plan view of a radiant tube combustion furnace with the roof removed.

For purposes of the description hereinafter, the words "upper", "lower", "right", "left", "vertical", "horizontal", "top", "bottom", "lateral", "longitudinal", "proximal", "distal" and like spatial terms, if used, shall relate to the described embodiments as oriented in the drawing figures. However, it is to be understood that many alternative variations and embodiments may be assumed except where expressly specified to the contrary. It is also to be understood that the specific devices and embodiments illustrated in the accompanying drawings and described herein are simply exemplary embodiments of the invention.

The present invention is directed to an insert for placement in the radiant tube of a furnace to increase heat transfer from the radiant tube to the material being heated. As shown in FIGS. 3 and 6-8, the insert 26, 126 includes a first section 28, 128 and a second section 30, 130, respectively.

The respective first sections 28, 128 include a tubular member 32, 132 having a first end 34, 134, a second end 36, 136, and a sidewall 38, 138 extending between the first end 34, 134 and the second end 36, 136. The sidewall 38, 138 defines at least one central passageway 40, 140. The sidewall 38, 138 may include at least one flat portion 42, 142 and at least one curved portion 44, 144.

Figure 3:
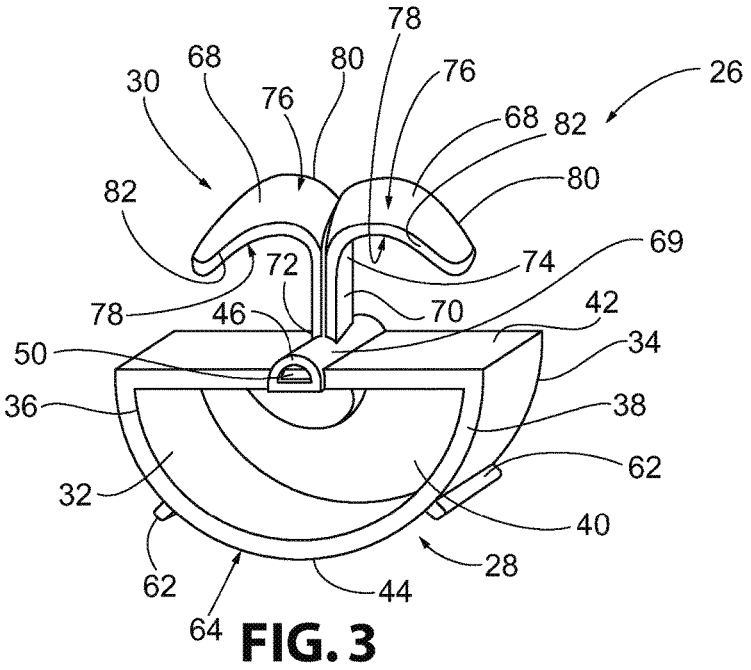
FIG. 3 is a perspective front view of one radiant tube insert according to the present invention.
Figure 6:
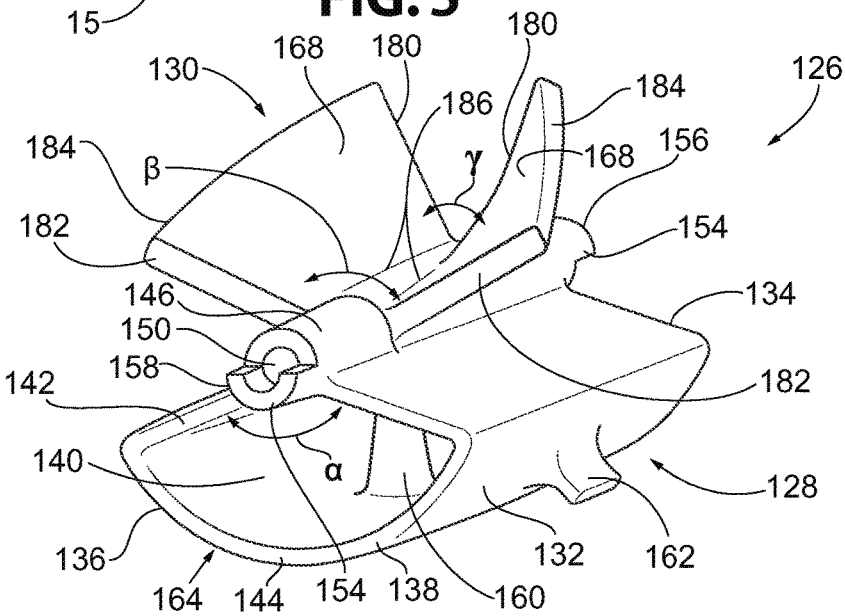
FIG. 6 is a perspective front view of another radiant tube insert according to the present invention.
Figure 7:
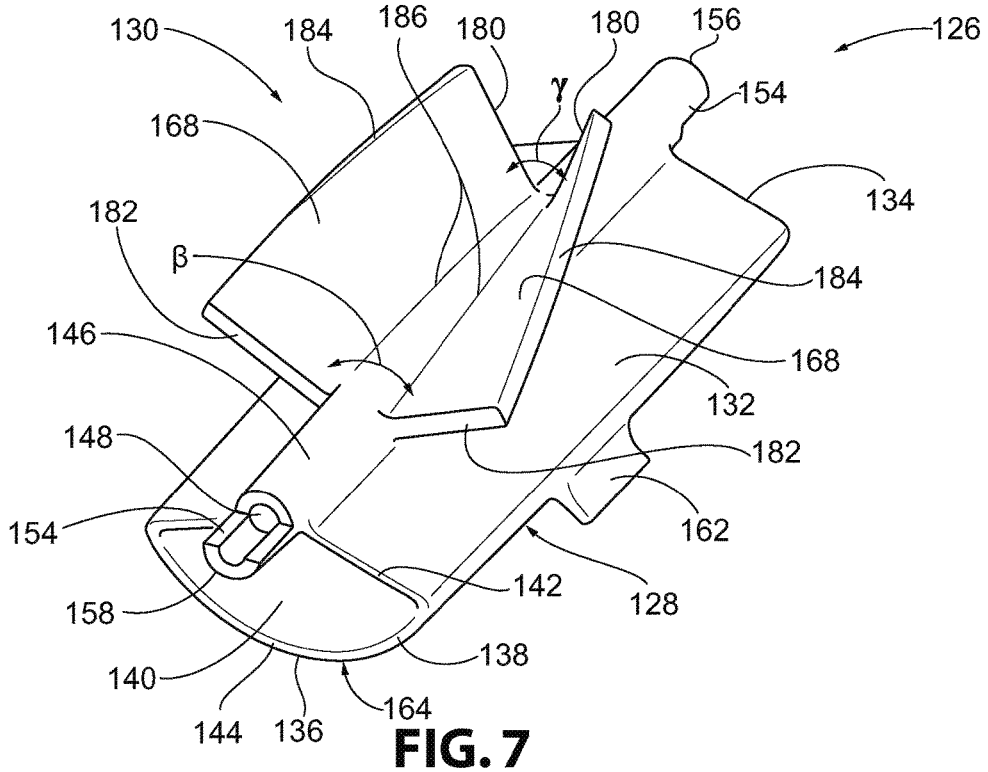
FIG. 7 is a perspective top view of the radiant tube insert of FIG. 6.
Figure 8:
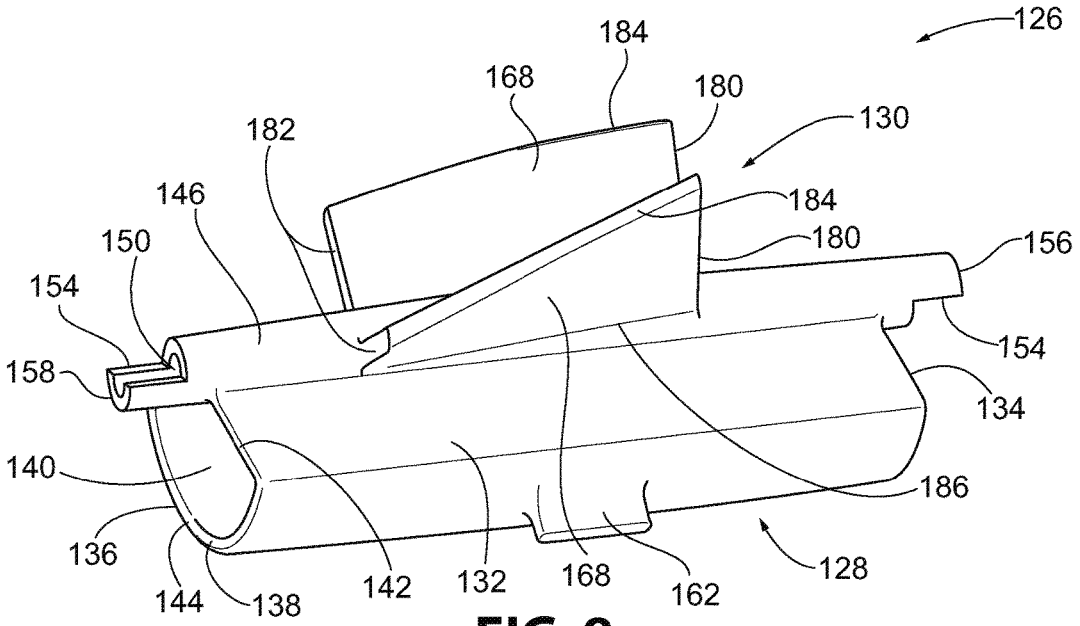
FIG. 8 is a perspective side view of the radiant tube insert of FIG. 6.

A connection channel 46, 146 may extend from the first end 34, 134 to the second end 36, 136 of the tubular member 32, 132 and be incorporated in or between the flat portions 42, 142 of the tubular member 32, 132. As shown in FIG. 3, the flat portions 42 of the tubular member 32 may extend from either side of the connection channel 46 in a substantially horizontal direction such that the cross-section of the sidewall 38 of the tubular member 32 is a semicircle. Alternatively, as shown in FIGS. 6-8, the flat portions 142 of the tubular member 132 may extend from either side of the connection channel 146 in a downward sloping manner such that the angle $\alpha$ between the flat portions 142 is less than 180° and the cross-section of the sidewall 138 of the tubular member 132 is a sector of a circle.

Figure 4:
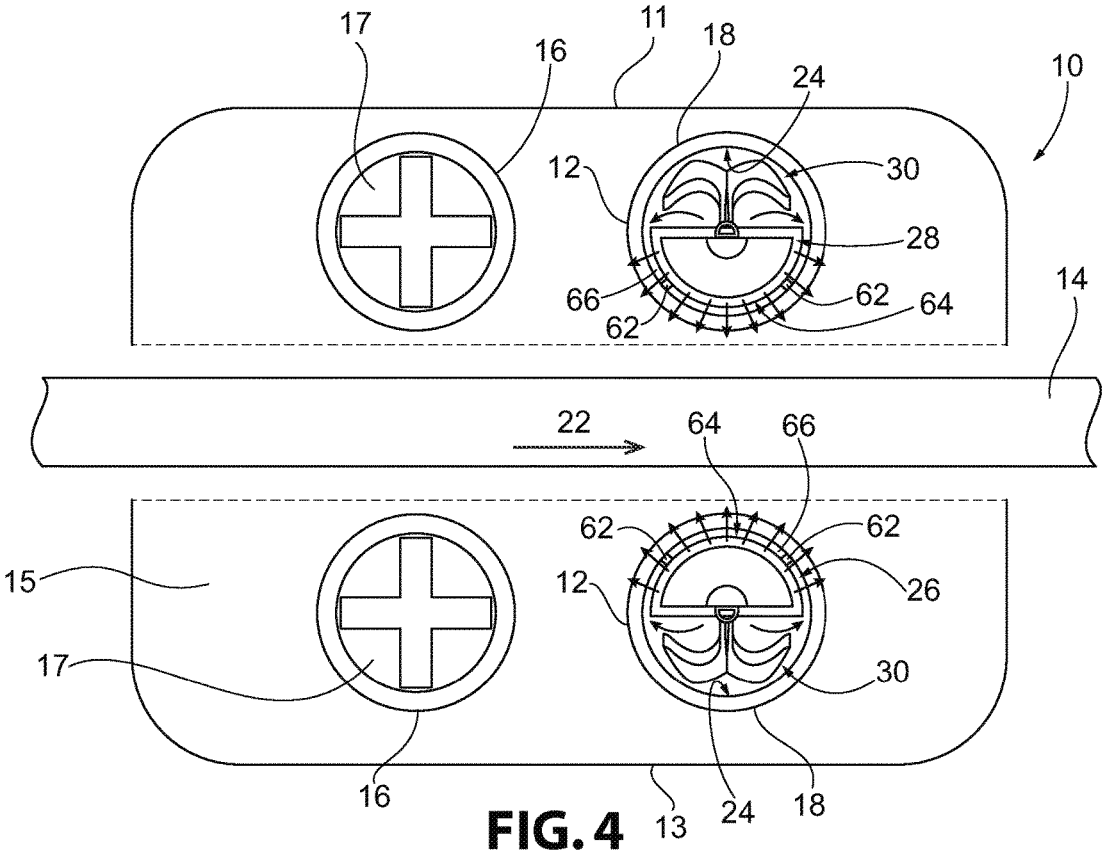
FIG. 4 is a side elevation view of the radiant tube insert of FIG. 3 installed in the radiant tube combustion furnace of FIGS. 1 and 2, with a portion of the side wall removed.
Figure 9:
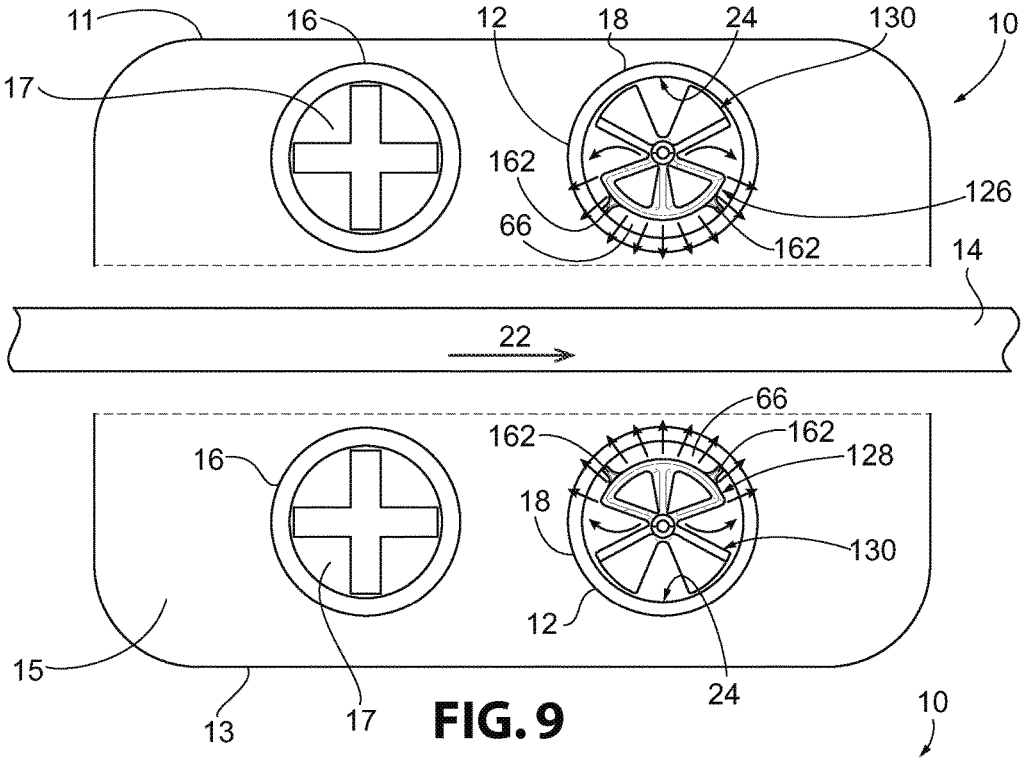
FIG. 9 is a side elevation view of the radiant tube insert of FIG. 6 installed in the radiant tube combustion furnace of FIGS. 1 and 2 with a portion of the side wall removed.

As shown in FIGS. 4 and 9, the curved portion 44, 144 of the sidewall 38, 138 may approximate the shape of the interior surface 24 of the radiant tube 12.

Figure 5:
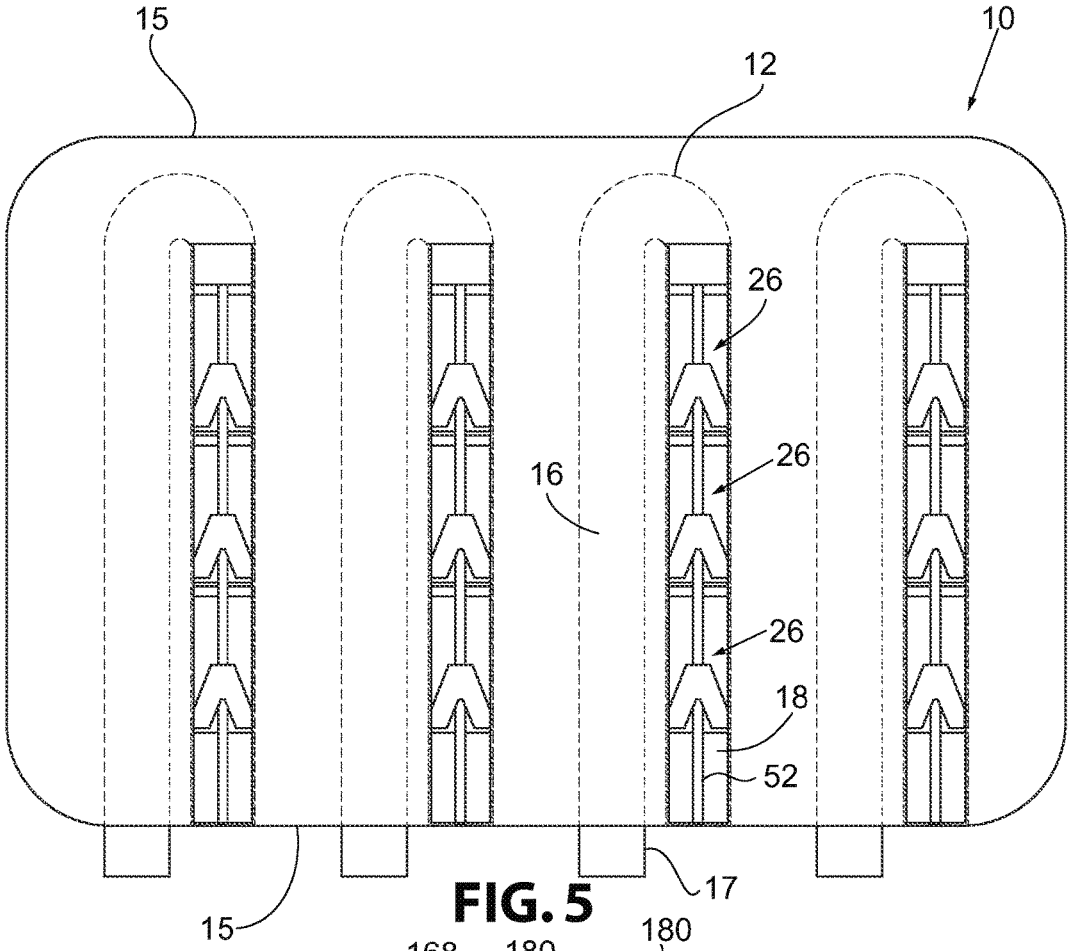
FIG. 5 is a top plan view, partially in section, of the radiant tube insert of FIG. 3 installed in the radiant tube combustion furnace of FIGS. 1 and 2, with the roof of the combustion furnace and the upper portion of the top set of radiant tubes removed.
Figure 10:
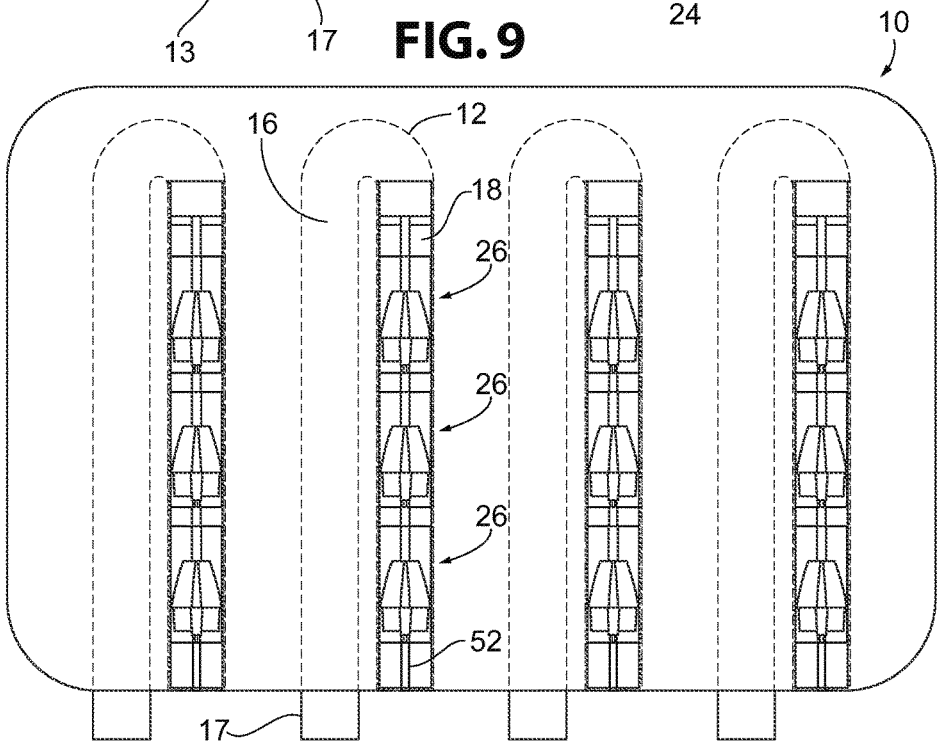
FIG. 10 is a top plan view, partially in section, of the radiant tube insert of FIG. 6 installed in the radiant tube combustion furnace of FIGS. 1 and 2, with the roof of the combustion furnace and the upper portion of the top set of radiant tubes removed.

As shown in FIGS. 5 and 10, the connection channel 46, 146 is adapted to receive a rod 52 within its central passageway 50, 150. The insertion of the rod 52 through the central passageway 50, 150 acts to connect a series of inserts 26, 126 together and may act to limit rotation of the insert 26, 126 when it is placed in the radiant tube 12. The central passageway 50 of the connection channel 46 may have a cross-section that is D-shaped to accept a rod 52 having a similarly D-shaped cross section (FIG. 3), or may have a circular cross section that accepts a rod 52 having a circular cross section (FIGS. 6-8). As shown in FIGS. 6-8, a lip 154 may extend from each end of the connection channel 146. On one end (first end 156), the lip 154 extends from the top of the connection channel 146 and has a semi-circular shape, and on the other end (second end 158), the lip 154 extends from the bottom of the connection channel 146 and also has a semi-circular shape. When the inserts 126 are placed in the radiant tube 12, the lip 154 on the first end 156 of one insert 126 engages the lip 154 on the second end 158 of the adjoining insert 126 to form a continuous passageway and to limit rotation of the adjoining inserts 126 relative to one another. Other suitable engagements may be employed to limit rotation of adjoining inserts 26, 126 relative to one another.

At least one support beam 160 may extend from the bottom surface of the connection channel 146 (FIGS. 6-8) or the interior surface of the flat portions 142 through the central passageway 140 of the first section 128 to the interior surface of the curved portion 144 of the second section 130.

At least one projection 62, 162 may extend from the exterior surface 64, 164 of the curved portion 44, 144 of the tubular member 32, 132. When inserted into the radiant tube 12, the projection 62, 162 acts to provide a gap 66 between the exterior surface 64, 164 of the sidewall 38, 138 of the tubular member 32, 132 and the interior surface 24 of the radiant tube 12. The projections 62, 162 may take any size, shape, orientation, and number as long as they act to provide a gap between the exterior surface 64, 164 of the sidewall 38, 138 of the tubular member 32, 132 and the interior surface 24 of the radiant tube 12. There may be two projections 62 having rectangular cross-sections and extending from the first end 34 of the tubular member 32 to the second end 36 of the tubular member 32 as shown in FIG. 3, or the projections 162 may only extend for a portion of the distance between the first end 134 of the tubular member 132 to the second end 136 of the tubular member 132 as shown in FIGS. 6-8.

Figure 2:
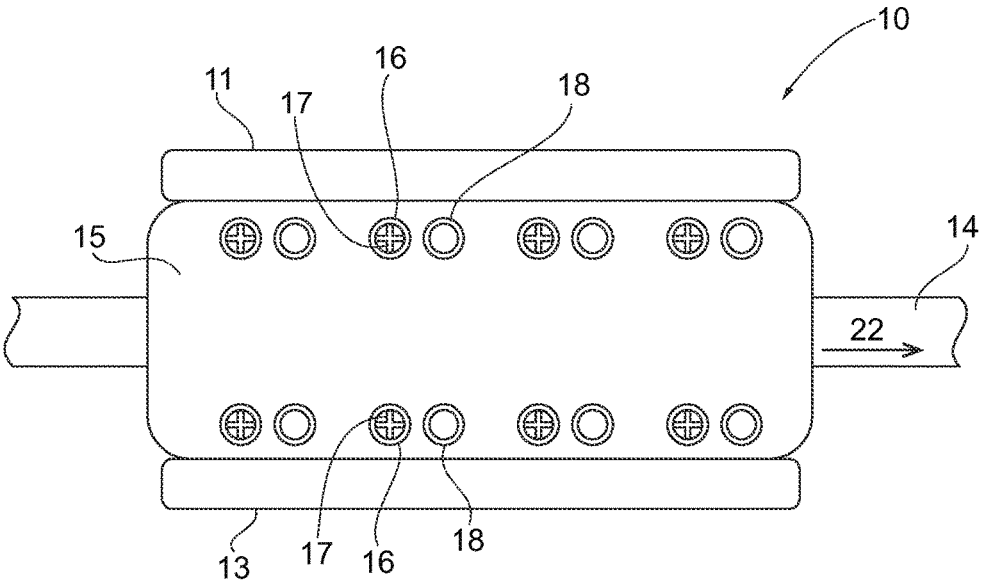
PRIOR ART FIG. 2
FIG. 2 is a side elevation view of the radiant tube combustion furnace of FIG. 1 with a portion of the side wall removed.

The shape of the first section 28, 128 is adapted to absorb the heat from the combustion gases passing through the radiant tube 12 and the central passageway 40, 140 of the tubular member 32, 132 and transfer this heat to the portion of the radiant tube 12 that is closest to the material 14 being heated. To accomplish this, as shown in FIGS. 4 and 9, the insert 26, 126 is placed in the radiant tube 12 such that the curved portion 44, 144 of the tubular member 32, 132 corresponds to the portion of the radiant tube 12 that is closest to the material 14 being heated. For example, in a furnace such as the one shown in FIGS. 1 and 2, where the material 14 being heated passes between two radiant tubes 12 with the direction 20 of the flow of gases through the radiant tubes 12 being perpendicular to the direction 22 of travel of the material 14 being heated, the curved portion 44, 144 of the tubular member 32, 132 is positioned to correspond to the lower half of the circumference of the upper radiant tube 12 and the upper half of the circumference of the lower radiant tube 12 (FIGS. 4 and 9).

By adapting the shape of the curved portion 44, 144 of the tubular member 32, 132 to closely approximate the shape of the radiant tube 12, a radiant view factor ratio (which is determined by the angle at which the thermal radiation contacts the lower temperature surface, i.e., the radiant tube 12) of nearly 1:1 is provided in the portion of the radiant tube 12 that is closest to the material 14 being heated. The flat portion 42, 142 of the tubular member 32, 132 faces the portion of the radiant tube 12 that is farthest from the material 14 being heated and provides a poor view factor to this portion of the radiant tube 12. In this way, the first section 28, 128 maximizes the amount of surface area of the insert 26, 126 that transmits its collected energy to the portion of the radiant tube 12 that is closest to the material 14 being heated and minimizes the heat transferred to the portion of the radiant tube 12 that is farthest from the material 14 being heated. Further, if the flat portions 142 of the tubular member 132 are sloped in a downward direction such that the angle $\alpha$ between the flat portions 142 is less than 180°, as shown in FIGS. 6-8, the hot gases on the outside of the tubular member 132 are also directed toward the portion of the radiant tube 12 that is closest to the material 14 being heated.

The second section 30, 130 may include at least one wing 68, 168 extending from an exterior surface of the flat portion 42, 142 of the tubular member 32, 132 or from the top exterior surface of the connection channel 46, 146. While the embodiments specifically described and shown herein have a pair of wings, it is to be recognized that the insert may have only a single wing or more than two wings.

As shown in FIG. 3, two wings 68 may extend from a first surface 69 of the connection channel 46. The wings 68 may share a vertical base portion 70 having a first end 72 and a second end 74. The first end 72 of the vertical base portion 70 of the wings 68 may be connected to the exterior surface of the flat portion 42 of the tubular member 32 or to the top exterior surface of the connection channel 46. Each wing 68 extends laterally from the second end 74 of the vertical base portion 70. The first exterior surface 76 of each wing 68 may be convex, and the second interior surface 78 of each wing 68 may be concave. Each wing 68 slopes in a downward direction from the first end 80 of the wing 68 to the second end 82 of the wing 68 such that the distance between the second end 82 of the wing 68 and the flat portion 42 of the tubular member 32 is smaller than the distance between the first end 80 of the wing 68 and the flat portion 42 of the tubular member 32.

As gases flowing through the radiant tube 12 contact the first end of the insert 26 and flow towards the second end of the insert 26, the curved shape and angled surface of the wings 68 cause swirling and/or turbulence of the gas, as shown by the arrows 22 in FIG. 4, which is believed to prevent laminar fluid flow through the radiant tube 12 and direct gases and energy toward the shell of the insert. This mixing of the gas inside of the radiant tube 12 eliminates the hot core of gasses that form when the gas flow is uninterrupted, as in exhaust sections of radiant tubes without inserts installed.

The angle and shape of the wings 68 are also configured to direct the gas to be in contact with the interior surface 24 of the radiant tube and the first section 28 of the insert 26 by directing the gas toward the exterior surface of the curved portion 44 of the insert 26 and into the gap 66 between the first section 28 and the portion of the radiant tube 12 that is closest to the material 14 being heated as shown by the arrows in FIG. 4.

Alternatively, the wings 168 may be attached directly to the top exterior surface of the flat portions 142 of the tubular member 132 or the top exterior surface of the connection channel 146, as shown in FIGS. 6-8. Each wing 168 may have a generally rectangular shape that may be twisted such that the laterally outer edge 184 of the second end 182 of the wing 168 is closer to the flat portion 142 of the tubular member 132 than the laterally outer edge 184 of the first end 180 of the wing 168. The first end 180 of each wing 168 is attached near the top portion of the connection channel 146 and the second end 182 of each wing 168 is attached on a side portion of the connection channel 146 such that the laterally inner edge 186 of the first end 180 of the wing 168 is farther from the flat portion 142 of the tubular member 132 than the laterally inner edge 186 of the second end 182 of the wing 168. The angle $\beta$ between the second ends 182 of the wings 168 is larger than the angle $\gamma$ between the first ends 180 of the wings 168. Each wing 168 slopes in a downward direction from the first end 180 of the wing 168 to the second end 182 of the wing 168.

Like the previously described wings 68 of FIG. 3, the wings 168 shown in FIGS. 6-10, are shaped to cause swirling and/or turbulence of the gas, as shown by the arrows in FIG. 9, which is believed to prevent laminar fluid flow through the radiant tube 12. The angle and shape of the wings 168 are also configured to force more gas to be in contact with the interior surface 24 of the radiant tube and the first section 128 of the insert 126 by directing the gas toward the exterior surface of the curved portion 144 of the insert 126 and into the gap 66 between the first section 128 and the portion of the radiant tube 12 that is closest to the material 14 being heated.

As shown in FIG. 3, the maximum width of the second section 30 may be slightly smaller than the maximum width of the first section 28. Alternatively, the second section 130 may have the same maximum width as the maximum width of the first section 128 (as shown in FIGS. 6-8) or a slightly larger maximum width than the maximum width of the first section 28, 128.

The length of the second section 30, 130 may be equal to or less than the length of the first section 28, 128. If the length of the second section 30, 130 is less than the length of the first section 28, 128, the second section 30, 130 may be attached to the first section 28, 128 at any position between the first end and the second end of the insert. For example, as shown in FIG. 3, the second section may be attached nearer the first end 34 of the tubular member 32 or, as shown in FIGS. 6-8, the second section 130 may be attached approximately mid-way between the first end 134 and the second end 136 of the tubular member 132.

The insert 26, 126 may be constructed from any suitable ceramic having good heat transfer, for example, silicon carbide or siliconized silicon carbide. The insert 26, 126 may also include a metal, such as palladium and/or platinum, deposited on the surface of the insert 26, 126, which reacts with and/or catalyzes exhaust gases such as $NO_x$ to reduce harmful emissions.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An insert for a radiant tube provided in a furnace for heating a material, the radiant tube comprising a passageway through which hot combustion gases flow and having a first side and a second side, the first side of the radiant tube positioned closest to the material being heated and the second side positioned farthest from the material being heated, the insert being configured for insertion into the passageway of the radiant tube and comprising:

a first section adapted to absorb heat from combustion gases passing through the radiant tube and transfer the heat to a wall of the radiant tube, the first section comprising a tubular member having a first end, a second end, and a sidewall extending between the first end and the second end and defining a passageway within the tubular member;

a projection extending from the exterior surface of the tubular member that acts to provide a gap between the exterior surface of the tubular member and an interior surface of the radiant tube; and a second section comprising a wing extending from an exterior surface of the tubular member, Wherein the wing has a first end corresponding to the first end of the tubular member and a second end corresponding to the second end of the tubular member and an exterior surface of the wing slopes from the first end of the wing to the second end of the wing to non-symmetrically direct heat and gases within the radiant tube, such that the heat and gases flow around the exterior of the tubular member and into the gap, and the first section and the second section of the inserts are together configured to direct heat from combustion gases passing through the radiant tube toward the first side of the first side of the radiant tube.

2. The insert of claim 1, wherein the shape of at least a portion of the first section approximates the shape of the radiant tube.

3. The insert of claim 1, wherein at least a portion of the sidewall of the tubular member is flat and at least a portion of the tubular member is curved.

4. The insert of claim 1, wherein the wing has a first end corresponding to the first end of the tubular member and a second end corresponding to the second end of the tubular member and a laterally outer edge of the second end of the wing is closer to the tubular member than a laterally outer edge of the first end of the wing.

5. The insert of claim 1, wherein the insert is ceramic.

6. The insert of claim 5, wherein the insert is constructed from a ceramic comprising silicon carbide.

7. The insert of claim 5, wherein the ceramic is coated with a metal.

8. The insert of claim 1 further comprising a connection channel.

9. A method of improving heat transfer from a radiant tube of a furnace to a material being heated in the furnace comprising: supplying an insert according to claim 1, and placing the insert into the radiant tube such that the first section of the insert corresponds to the first side of the radiant tube that is closest to the material being heated.

10. The method of claim 9, wherein the at least one wing has a first end corresponding to the first end of the tubular member and a second end corresponding to the second end of the tubular member and an exterior surface of the wing slopes in a downward direction from the first end of the wing to the second end of the wing.

11. The method of claim 9, wherein the at least one wing has a first end corresponding to the first end of the tubular member and a second end corresponding to the second end of the tubular member and a laterally outer edge of the second end of the wing is closer to the tubular member than a laterally outer edge of the first end of the wing.

12. The insert of claim 7, wherein the metal is at least one of palladium and platinum.

13. A system for heating a material, the system comprising:

a radiant tube having a fluid passageway, a first side, and a second side, the first side of the radiant tube positioned closest to the material being heated and the second side positioned farthest from the material being heated; and one or more inserts provided in the fluid passageway of the radiant tube, wherein the inserts comprise:

a first section adapted to absorb heat from combustion gases passing through the radiant tube and transfer the heat to a wall of the radiant tube, the first section comprising a tubular member having a first end, a second end, and a sidewall extending between the first end and the second end and defining a passageway within the tubular member;

a projection extending from the exterior surface of the tubular member that acts to provide a gap between the exterior surface of the tubular member and an interior surface of the radiant tube; and a second section comprising a wing extending from an exterior surface of the tubular member, Wherein the wing has a first end corresponding to the first end of the tubular member and a second end corresponding to the second end of the tubular member and an exterior surface of the wing slopes from the first end of the wing to the second end of the wing to non-symmetrically direct heat and gases within the radiant tube, such that the heat and gases flow around the exterior of the tubular member and into the gap, and the first section and the second section of the inserts are together configured to direct heat from combustion gases passing through the radiant tube toward the first side of the first side of the radiant tube.

14. The system of claim 13, wherein a plurality of inserts are connected to one another within the fluid passageway.

* * * * *